US010827790B2

(12) United States Patent
Burdett

(10) Patent No.: US 10,827,790 B2
(45) Date of Patent: Nov. 10, 2020

(54) GARMENT CLOSURE

(71) Applicant: Johanna Burdett, Manly (AU)

(72) Inventor: Johanna Burdett, Manly (AU)

( * ) Notice: Subject to any disclaimer, the term of this patent is extended or adjusted under 35 U.S.C. 154(b) by 44 days.

(21) Appl. No.: 16/315,849

(22) PCT Filed: Jul. 5, 2017

(86) PCT No.: PCT/AU2017/050695

§ 371 (c)(1),
(2) Date: Jan. 7, 2019

(87) PCT Pub. No.: WO2018/006128

PCT Pub. Date: Jan. 11, 2018

(65) Prior Publication Data

US 2019/0142091 A1 May 16, 2019

(30) Foreign Application Priority Data

Jul. 6, 2016 (AU) ..... 2016902653

(51) Int. Cl.
*A41F 1/00* (2006.01)
*A44B 1/00* (2006.01)

(52) U.S. Cl.
CPC ..... *A41F 1/008* (2013.01); *A41F 1/002* (2013.01); *A44B 1/00* (2013.01)

(58) Field of Classification Search
CPC . A41F 1/008; A41F 1/002; A41F 1/00; A44D 2203/00; Y10T 24/3497; Y10T 24/3498; Y10T 24/32; A44B 1/00
See application file for complete search history.

(56) References Cited

U.S. PATENT DOCUMENTS

| | | | | |
|---|---|---|---|---|
| 610,989 | A * | 9/1898 | James | A41B 3/08 24/379.1 |
| 4,939,794 | A * | 7/1990 | Aronson | A41B 1/16 2/115 |
| 5,729,875 | A | 3/1998 | Margulis | |
| 7,409,730 | B2 * | 8/2008 | Boos | A41F 1/002 2/132 |
| 8,667,650 | B1 | 3/2014 | Duffin | |
| 9,210,953 | B2 * | 12/2015 | Horton | A41B 1/10 |
| 2009/0265832 | A1 | 10/2009 | Clement | |
| 2012/0117764 | A1 | 5/2012 | Wong | |
| 2012/0324710 | A1 | 12/2012 | Panopoulos | |

* cited by examiner

*Primary Examiner* — Robert Sandy
(74) *Attorney, Agent, or Firm* — Laurence A. Greenberg; Werner H. Stemer; Ralph E. Locher

(57) ABSTRACT

A garment closure is provided for closing a gape formed between first and second panels of a garment. The garment closure has a first retainer including a biasing member, for retaining the first panel of the garment; and a second retainer, coupled to said first retainer, for retaining the second panel of the garment, to thereby close a gape between the lower panel and the upper panel of the garment.

20 Claims, 5 Drawing Sheets

GARMENT CLOSURE

TECHNICAL FIELD

The present invention relates to the fastening of garments. In particular, although not exclusively, the present invention relates to the closure of clothing and the prevention of gaps forming in the placket of shirts.

BACKGROUND ART

Shirts are often test fitted when the wearer is standing up, and purchased based upon that impression. However, when the same person sits down, a gape often forms between the buttons of the shirt where the panels of the shirt separate. This can negatively influence the appearance of the shirt, of even cause embarrassment to the wearer, particularly if the wearer's underwear is visible through the gape.

The gape from a shirt may form at different points depending upon the wearers frame. In females, this often occurs around the chest area, and in males in the upper stomach, around the belly-button. Sitting down, leaning forward or bending often accentuates the gape.

Several attempts have been made to overcome the above problem, all with one or more drawbacks or disadvantages, as outlined below.

In some shirts of the prior art, the placket is sewn together to prevent a gape from occurring at all. A problem, however, with such an approach is that it can be difficult, or simply not possible, to put on and take off a tight fitting shirt if it is not able to be unbuttoned or otherwise opened.

In other shirts, extra buttons are provided to prevent or reduce the gape. However, a problem with such shirts is that the gape forms in different areas depending on the shape of the wearer, meaning either a) the extra buttons prevent gape for certain wearers only, or b) there is a very large number of buttons making it difficult to put the shirt on and off.

In any event, both of the above solutions also require modification to the shirt, which is costly and time consuming, and may not even be possible while retaining the original design of the shirt.

In certain situations, double-sided tape has been used to prevent shirt panels from separating. A problem with using tape in such manner is that it is generally not reusable (tape loses its adhesive properties after being used), and is thus costly to maintain, particularly if used on a daily basis. Adhesive from the tape can also transfer to the shirt causing discolouration to the shirt.

Pins have also been used to prevent shirt panels from separating. A problem with pins is that they are generally difficult to attach in the correct position, they present a stabbing hazard, and can cause holes to form in the shirt from repeated use.

Similar problems exist when buttons become loose or fall off garments, such as shirts, trousers, shorts or skirts. In particular, the loose or missing button may create an unwanted gape or opening in the garment.

If the user is unable to repair the garment, he or she may be required to send the garment in for repair, which is costly and time consuming. As such, in many cases the user may simply cease to use a garment, despite the garment being otherwise without fault.

Pins are not particularly suitable for use in such case, as they are difficult to attach in the correct position, especially around the waist area, they present a stabbing hazard, and can cause holes to form in the garment from repeated use, as outlined above.

Similar problems exist in other garments, such as V-neck tops, even without fault, due to different sizes of wearers. In particular, some V-neck garments sit too low on some wearers, negatively influencing the appearance of the garment. This can cause embarrassment to the wearer, particularly if the wearer's underwear or cleavage is visible. The problem is often accentuated when the wearer is sitting down, as the garment material is generally more stretched than when the wearer is standing.

Several attempts have also been made to overcome this problem, including modification of the garment (e.g. by sewing the V-portion together to provide a shallow neckline), which is costly and time consuming, and may negatively impact the original design of the garment, and the use of double-sided tape and pins, both of which are problematic, as outlined above.

As such, there is clearly a need for an improved garment closure.

It will be clearly understood that, if a prior art publication is referred to herein, this reference does not constitute an admission that the publication forms part of the common general knowledge in the art in Australia or in any other country.

SUMMARY OF INVENTION

The present invention is directed to a garment closure, which may at least partially overcome at least one of the abovementioned disadvantages or provide the consumer with a useful or commercial choice.

With the foregoing in view, the present invention in one form, resides broadly in a garment closure for closing a gape formed between first and second panels of a garment, the garment closure comprising:

a first retainer including a biasing member, for retaining the first panel of the garment; and a second retainer, coupled to the first retainer, for retaining the second panel of the garment, to thereby close the gape.

In some embodiments, the gape is formed between fasteners connecting the panels. In other embodiments, the gape is formed between adjacent panels of a V-neck, where the panels comprise opposing sides of the V-neck.

Preferably, the second retainer is non-intrusive. Preferably, the first retainer is non-intrusive.

Preferably, the first and second panels are overlapping. Preferably, the first and second retainers are overlapping.

Preferably, the first retainer is configured to retain the first panel independently of the second retainer retaining the second panel.

Preferably, the first retainer comprises a retaining member.

Preferably, the biasing member comprises a clamping member.

Preferably the clamping member comprises first and second resilient members. Suitably, the first and second resilient members extend in approximately the same direction.

The first resilient member may be located above the second resilient member. The first resilient member may be located adjacent to the second resilient member.

Preferably, the clamping member comprises gripping surfaces, for gripping to the first panel of the garment. The gripping surfaces may comprise a rubber coating.

Preferably, the second retainer comprises a magnet assembly.

The magnet assembly may comprise an outer assembly of the garment closure, adjacent to an outside of the garment, and the first retainer may comprise an inner assembly of the garment closure, adjacent to an inside of the garment.

The magnet assembly may comprise an inner magnet, coupled to the first retainer and on an inside of the second panel, and an outer magnet, configured to be outside of the second panel.

The magnet assembly may comprise a first magnet, coupled to the first retainer, and a second magnet comprising the second retainer, wherein the second magnet is configured to be adhered to an inside of the second panel. Preferably, the second magnet is configured to be releasably adhered to the inside of the second panel.

The second retainer may include an adhesive coating, for retaining the second panel of the garment.

Preferably, the garment closure include a button adhered to the second outer magnet.

Preferably, the garment closure includes slider, configured to enable the magnet assembly to slide relative to the first retainer. The slider may be configured to slide in a single dimension. The slider may include notches to keep the slider from moving while being worn.

Alternatively, the second retainer comprises a retaining member. The retaining member may comprise a clamping member.

Preferably, the clamping member is at least partly transparent.

Preferably, the garment closure is reusable.

Preferably, the first and second panels are panels of a shirt, shorts, trousers or a skirt. Preferably, the first and second fasteners are buttons.

Advantageously, embodiments of the present invention work without the use of a pin, which prevents damage to the clothing and is not a stabbing hazard, are easy to use, comfortable, durable and adjustable and aesthetically pleasing.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Various embodiments of the invention will be described with reference to the following drawings, in which.

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows:

DESCRIPTION OF EMBODIMENTS

Figure 1:
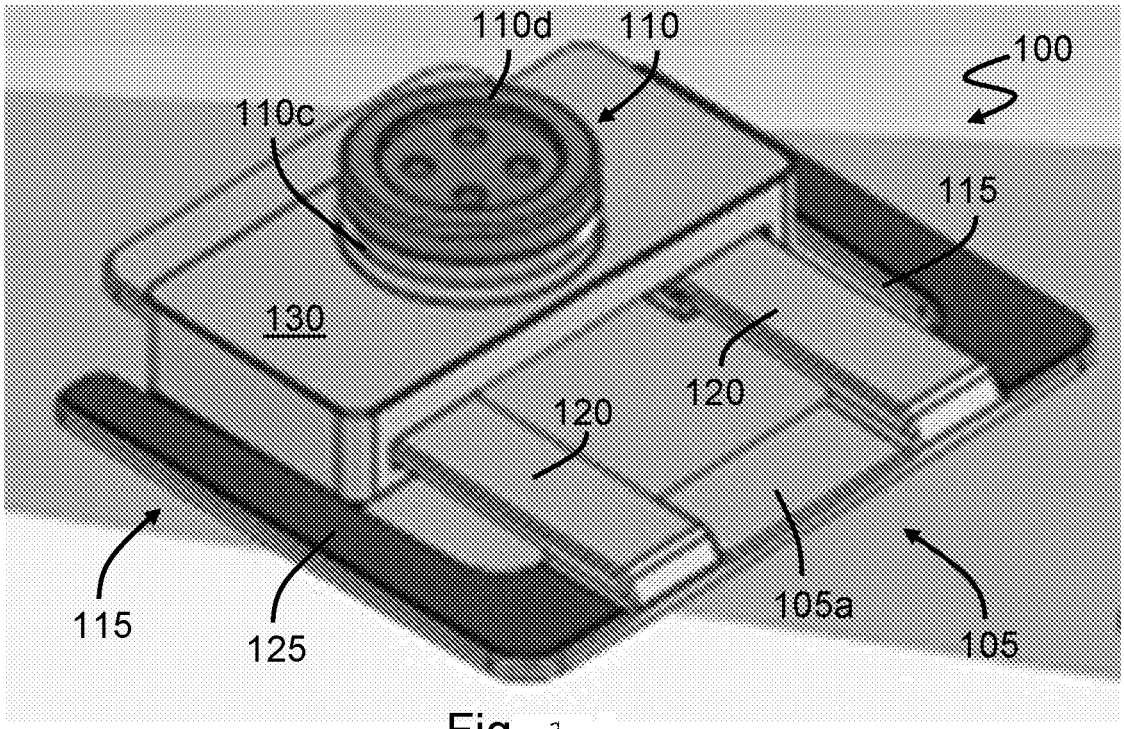
FIG. 1 illustrates a garment closure, according to an embodiment of the present invention.
Figure 2:
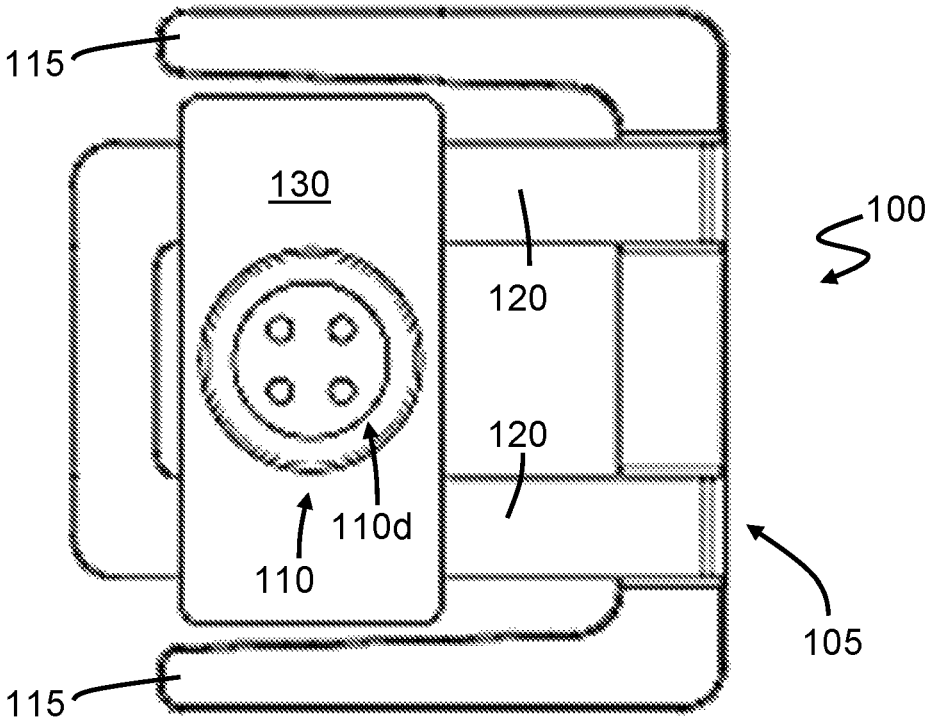
FIG. 2 illustrates a top view of the garment closure of FIG. 1.
Figure 3:
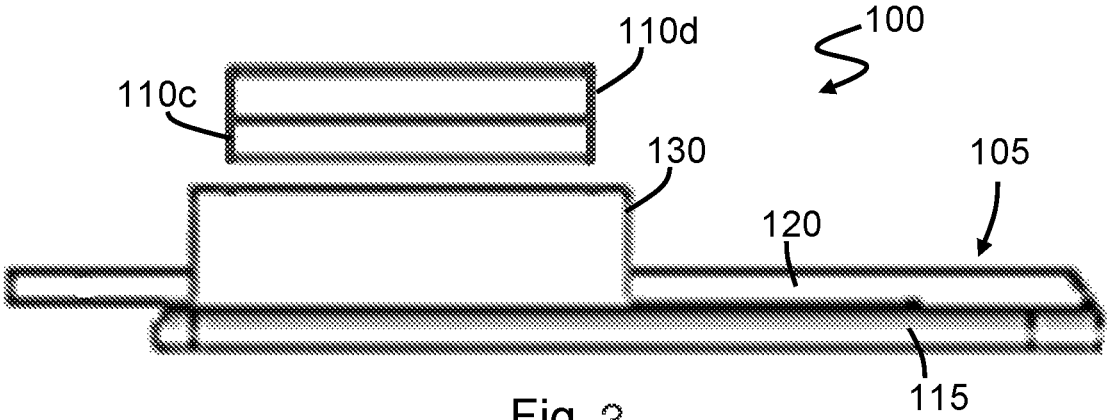
FIG. 3 illustrates a side view of the garment closure of FIG. 1.
Figure 4:
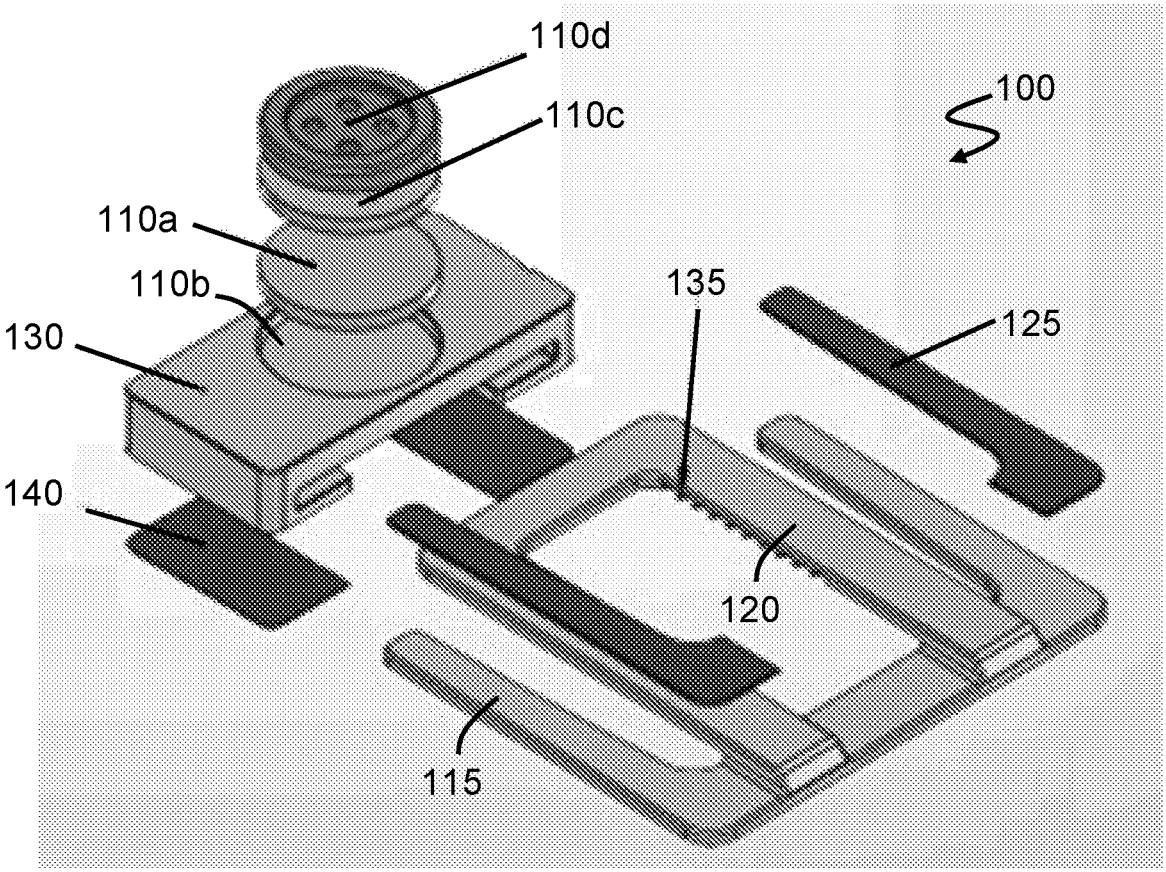
FIG. 4 illustrates an exploded perspective view of the garment closure of FIG. 1.

FIG. 1 illustrates a garment closure 100, according to an embodiment of the present invention. FIG. 2 illustrates a top view of the garment closure 100, FIG. 3 illustrates a side view of the garment closure 100, and FIG. 4 illustrates an exploded perspective view of the garment closure 100.

The garment closure 100 advantageously prevents or reduces gaping between overlapping panels of a shirt between adjacent buttons on the shirt, which typically occur in a bust/chest/stomach area for women or in chest or stomach areas for men. The garment closure may, however, be used on shirts with press studs instead of buttons, or on any other suitable garment, with or without buttons, such as dresses, overalls and the like.

Furthermore, the garment closure 100 can be used in place of re-attaching a button on a garment when a button is lost or has fallen off. Similarly, the garment closure may be used to close any type of gape formed between panels of a garment, whether the garment has buttons or not. As an illustrative example, the garment closure can be used to reduce the depth of a V-neck of a top.

The garment closure 100 includes a lower retainer in the form of a clip 105, for retaining a lower panel of the garment, and an upper retainer comprising a magnet assembly 110, coupled to the lower retainer and for retaining an upper panel of the garment.

When used to close a gape forming between buttons of a shirt, the garment closure 100 is positioned between two buttons of the shirt. The upper retainer prevents outward protrusion of the outer panel of the shirt, and the lower retainer prevents inward collapsing of the lower panel of the shirt, thereby preventing or reducing gaping in the shirt.

Alternatively, the garment closure 100 may be is positioned by a buttonhole of a garment, to close the garment when a corresponding button is missing. In such case, the upper retainer prevents outward protrusion of an outer panel of the garment, and the lower retainer prevents inward separation of the lower panel of the garment, thereby closing the gape that exists through the missing button.

Alternatively again, the garment closure 100 may be positioned at the bottom of a V-neck of a top to reduce a depth of the V. In such case, the upper retainer prevents outward protrusion of one side of the V-neck, and the lower retainer prevents inward collapsing the other side of the V-neck.

The clip 105 comprises a pair of outer arms 115 that extend outwardly from a base 105*a* of the clip, and a pair of inner arms 120 that also extend outwardly from the base 105*a*. The inner and outer arms are substantially parallel and extend from the base in substantially the same direction.

As best illustrated in FIG. 3, an upper surface of the outer arms 115 and a lower surface of the inner arms 120 lie substantially in a plane, and are configured to receive the lower panel of the garment there between. In particular, when in use, the outer arms 115 are positioned against an underside of the lower panel of the garment, and the inner arms 120 are positioned against an overside of the lower panel such that a clamping force is applied to the lower panel of the garment by the inner and outer arms 120, 115.

This enables the clip 105 to simply slide onto the lower portion of the garment, making it easy to use, whilst not being hazardous to the wearer or damaging to the garment as pins are. The clip is resilient (i.e. has some flex in it) to make sure that it can be easily clamped to the garment and later removed.

An upper surface of the outer arms 115 includes a non-slip coating 125 in the form of a rubber sheet attached to the arms. The non-slip coating 125 assists in preventing the clip 105 from inadvertently moving relative to the lower panel of the garment, which in turn prevents the garment closure 100 from moving or falling off the garment. This is particularly advantageous when the wearer is moving. According to alternative embodiments (not illustrated), a clip may be provided without a non-slip coating on the arms or elsewhere. In such case, the clip itself clamps against the garment. The clip may include curvature, e.g. in arms thereof, such that the clip provides further bias against the garment further in such case.

A slider 130 engages with the inner arms 120, and can slide back and forward along the inner arms 120, i.e. in one dimension. A lower magnet 110*a* of the magnet assembly 110 is coupled to the slider, and in particular into a recess 110*b* of the slider such that an upper surface of the lower magnet 110*a* is flush with an upper surface of the slider 130. As a result, a substantially flat surface is provided against the upper panel of the garment, which can assist in preventing wrinkles from forming in the garment.

An upper magnet 110*c* is coupled to a button 110*d*, and is configured to attract to the lower magnet 110*a*. In use, the upper panel is positioned between the upper magnet 110*c* and the lower magnet 110*a*, and held in place by a magnetic force therebetween which clamps the upper panel. Visually, the upper magnet 110*c* is shielded by the button 110*d* such that the upper magnet 110*c* is generally not visible, or at least minimally visible.

The upper magnet 110*c* may be provided with adhesive, to enable the wearer to permanently (or semi-permanently) attach a spare button thereto. In such case, the wearer may choose the form of the button 110*d*.

The slider 130 enables the button 110*d* to be positioned such that it is aligned with other buttons of the shirt, for example, to provide an aesthetically pleasing look. In particular, the button 110*d* may be positioned laterally through movement of the slider 130, which in turn moves the magnet 110*a*. This is particularly advantageous on a placket of the shirt, as the buttons of the placket generally form a single line, and an out of line button may stand out.

In an alternative embodiment, the upper magnet 110*c* is directly adhered to an inside of the upper panel of the garment, and is thus used without the button 110*d*. In such case, the upper magnet 110*c* may include an adhesive outer layer, with which it attaches to the upper panel of the garment, and is configured to engage with the lower magnet 110*a* to hold the garment closed. In such case, the upper magnet 110*c* is not able to be seen, which provides an aesthetically pleasing modification to the garment.

The adhesive outer later of the upper magnet 110*c* may be reusable, to enable the wearer to attach and remove the upper magnet 110*c* to various garments, or to buttons.

The slider 130 enables the garment closure 100 to be adjusted to reduce (or adjust) the V depth, thus enabling an aesthetically pleasing look.

The magnets 110*a*, 110*c* are preferably rare earth magnets, such as neodymium magnets, to provide a strong hold with a small size. This in turn prevents the magnets 110*a*, 110*c* from accidently separating, keeps weight of the garment closure 100 to a minimum, and enables the magnets to be sufficiently strong to prevent the magnets 110*a*, 110*c* from accidently separating.

According to certain embodiments, an upper surface of the lower magnet 110*a*, and a lower surface of the upper magnet 110*c* are provided with non-slip gripping material attached, which further prevents the magnets from sliding off of the garment.

As best illustrated in FIG. 4, the inner arms 120 include a plurality of alignment notches 135, to keep the slider 130 in place when worn. In particular, the slider 130 may slide over the notches 135 when lateral force is applied to the slider 130 with reference to the arms 120, but is held in place by the notches 135 otherwise. This prevents inadvertent movement of the slider 130, and thus the magnet assembly 110, when in use.

The clip 105 is able to be attached to the lower garment panel independently of the upper garment panel, which greatly simplifies use of the garment closure 100. As a result, the wearer does not have to hold onto the lower section whilst attaching the upper section, which is the case for pins, meaning that the garment closure 100 can be positioned in a suitable place for the garment to align with other buttons, in the case of the button-down shirt, or to align with the buttonhole in the case of shirts, trousers, shorts or skirts or the like.

As the garment closure 100 releasably clamps to the panels of the garment, it can be removed from the garment before washing, and even used on various garments interchangeably, and without damage to the garment(s).

As illustrated in FIG. 4, an underside of the slider 130 also includes a non-slip coating 140 (gripping surface), to prevent movement of the slider 130 relative to the lower garment panel. This, together with the non-slip coating 120 provides gripping on both sides of the lower garment panel.

The clip 105 may be formed of metal, plastic, or any other suitable resilient material. Preferably, the outer arms 115 and the inner arms 120 are somewhat flexible (resilient) to simplify installation of the clip 105. Advantageously, the clip 105 is unitarily formed.

Similarly, the slider 130 may be formed of metal, plastic, or any other suitable material. Preferably, the slider 130 is formed of plastic and the clip 105 is formed of metal.

Figure 5:
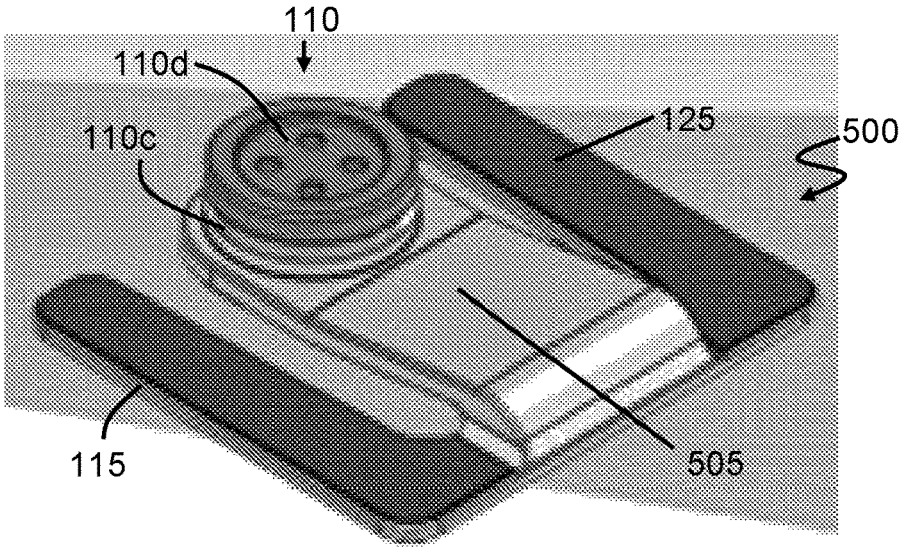
FIG. 5 illustrates a perspective view of a garment closure, according to an alternative embodiment of the present invention.

FIG. 5 illustrates a perspective view of a garment closure 500, according to an alternative embodiment of the present invention. The garment closure 500 is similar to the garment closure 100, but includes a single central arm 505, instead of the inner arms 120.

Furthermore, the garment closure 500 does not include a slider, but instead, the lower magnet is placed in a fixed position on the central arm 505. As such, the button 110*d* is placed in a fixed position relative to the garment closure 500.

In use, to the clip 105 of the garment closure 100, the outer arms 115 and the central arm 505 clamp the inner panel of the garment, whereas the button assembly 110 clamps the outer panel of the garment.

As such, the garment closure 500 may be used to prevent gaping of a shirt, the closure of a gap caused by a missing button in a garment, or to reduce a depth of the V-neck of a top, in a similar manner as described above.

Figure 6:
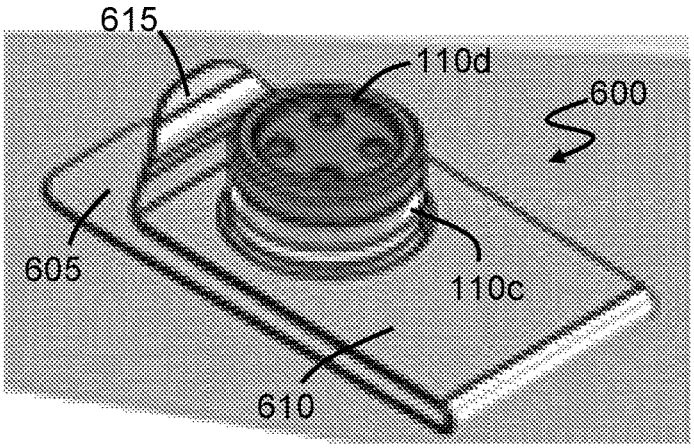
FIG. 6 illustrates a perspective view of a garment closure, according to an alternative embodiment of the present invention.

FIG. 6 illustrates a perspective view of a garment closure 600, according to an alternative embodiment of the present invention.

The garment closure 600 is similar to the garment closure 500, but includes a single lower arm 605, instead of the outer arms 115. Similarly, an upper arm 610, similar to the central arm 505, is provided. The upper arm 610 is positioned directly above the upper arm 610, and provides clamping to the lower panel of the garment in a similar manner to that described above.

The lower arm 605 and the upper arm 610 may be formed by folding a single piece of sheet material, such as sheet metal, which may reduce overall manufacturing costs.

The upper arm 610 includes a raised end 615, which acts as a guide to guide the lower garment panel between the lower arm 605 and the upper arm 610 to facilitate ease of applying the closure 600 to the garment. This raised arm also assists with putting the clip on by giving the wearer something to hold onto.

The closure 600 includes rounded edges for user comfort and to prevent accidental scratching of the skin. Furthermore, the side of the clip against the body is completely flat to ensure user comfort.

The garment closure 600 may be used to prevent gaping of a shirt, the closure of a gap caused by a missing button in a garment, or to reduce a depth of the V-neck of a top, in a similar manner as described above.

Figure 7:
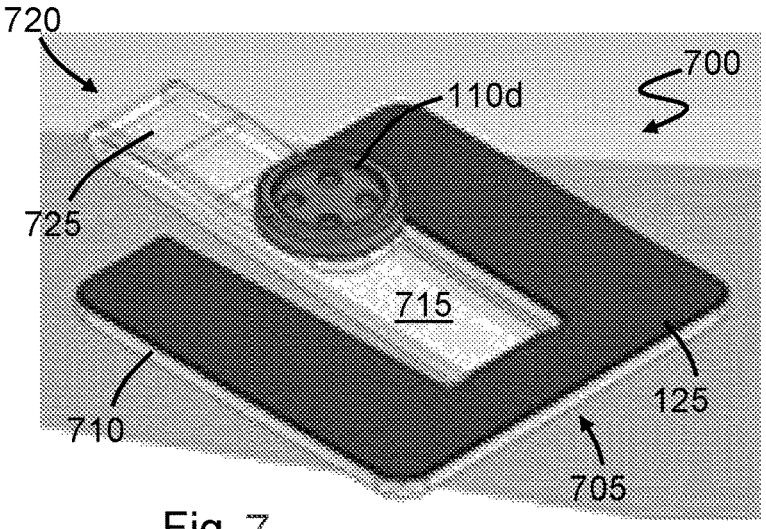
FIG. 7 illustrates a perspective view of a garment closure, according to an alternative embodiment of the present invention.

FIG. 7 illustrates a perspective view of a garment closure 700, according to an alternative embodiment of the present invention.

The garment closure 700 includes a lower clip 705, similar to the clip 105, for retaining a lower panel of the garment. The clip comprises a pair of outer arms 710, with a central arm 715 there between. The outer arms 710 and the central arm 715 provide a clamping force to the lower panel of the garment, much like the clips described above.

The garment closure 700 further includes an upper clip 720, for retaining the upper panel of the garment. The upper clip 720 is formed by the central arm 715, and an upper arm 725, that extends along and above the central arm 715.

The upper clip 720 replaces the magnet assembly 110 in that it retains the upper shirt panel in place, but functions similar to the lower clip 705 rather than magnetically.

As the button 110*d* is placed on the upper clip 715 (e.g. by the wearer with adhesive which may be provided), the upper clip 715 is advantageously transparent or semi-transparent. In some embodiments, the upper clip 715 and the lower clip 705 are formed of a single piece of transparent material such as plastic.

The garment closure 700 may be used to prevent gaping of a shirt, or the closure of a gap caused by a missing button in a garment, in a similar manner as described above. Furthermore, in alternative embodiments, the button 110*d* may be removed, and the upper arm 725 may be transparent, enabling the garment closure to reduce a depth of the V-neck of a top, in a similar manner as described above. In such case, however, the upper arm extends over a front of the garment.

In other embodiments, metal or other non-transparent materials may be used. Similarly, the upper clip 715 may be decorative, rather than hidden.

Figure 8:
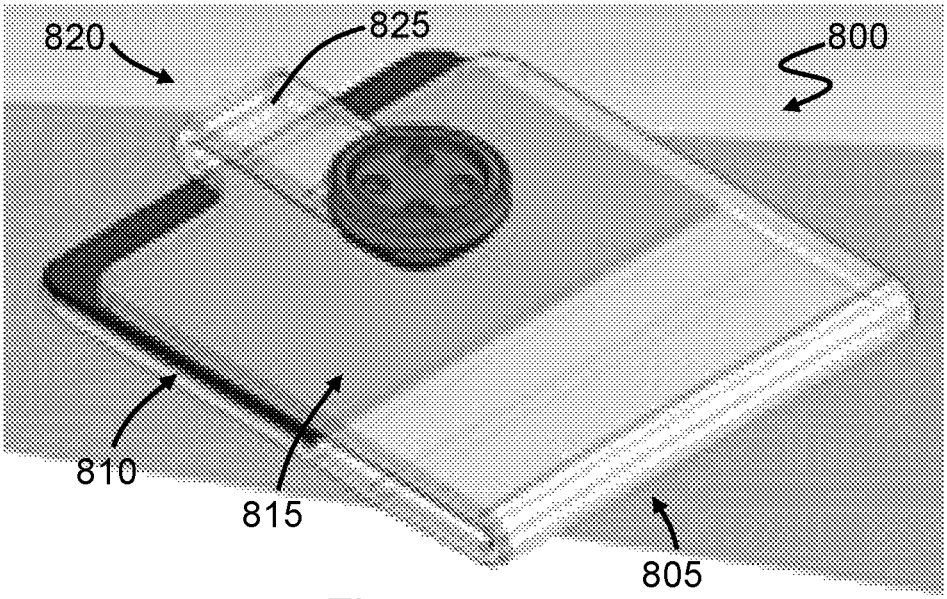
FIG. 8 illustrates a perspective view of a garment closure, according to an alternative embodiment of the present invention.

FIG. 8 illustrates a perspective view of a garment closure 800, according to an alternative embodiment of the present invention. The garment closure 800 is similar to the garment closure 700 and includes a lower clip 805, similar to the lower clip 705, but comprising a lower plate 810, and a central plate 815 directly above the lower plate 805, in which the lower shirt panel is clamped.

Similarly, an upper clip 820, similar to the upper clip 720, is provided by the central plate 815 and an upper arm 825, similar to the upper arm 725.

The garment closure 800 may be used to prevent gaping of a shirt, to provide for the closure of a gap caused by a missing button in a garment, or to reduce a depth of the V-neck of a top, in a similar manner as described above.

Figure 9:
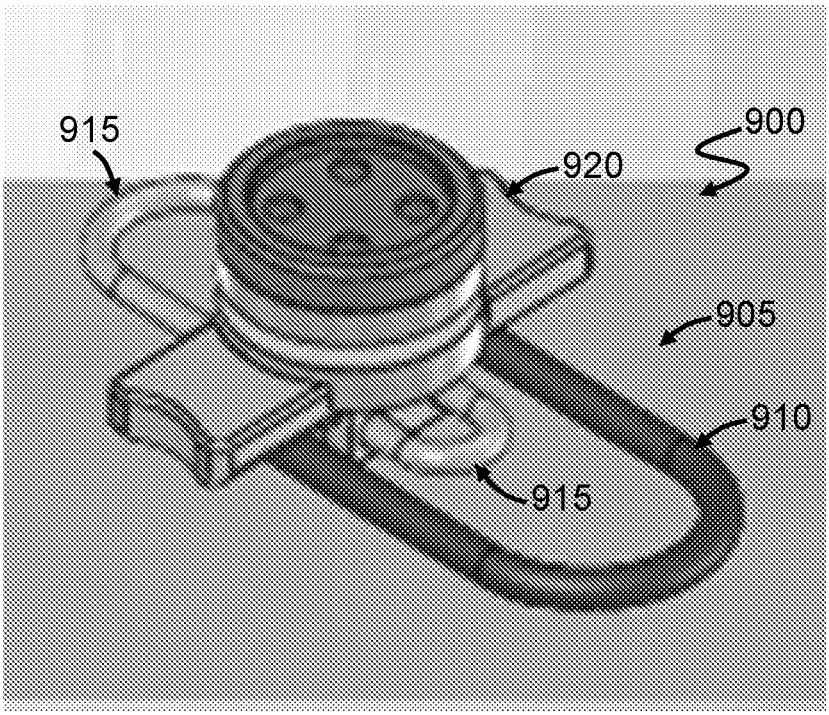
FIG. 9 illustrates a perspective view of a garment closure, according to an embodiment of the present invention.

FIG. 9 illustrates a perspective view of a garment closure 900, according to an embodiment of the present invention. The garment closure 900 is similar to the garment closures depicted in FIGS. 1-6 and include a lower clip 905, comprising a lower clip member 910 and an upper clip member 915, there between the lower panel of the shirt is received, a slider 920, and the button assembly 110 disposed on the slider 920.

The slider 920 includes first and second apertures, for receiving portions of the upper clip member 915, and is configured to enable the slider to slide along straight edges of the upper clip member 915.

The lower clip 905 is formed of pliable steel wire which is twisted to form the lower clip member 910 and the upper clip member 915. The lower clip 905 comprises of between about 3 and 6 twists in a common plane, configured to grip (hold) onto the garment.

A lower portion of the clip 905, corresponding approximately to the lower clip member 910, is coated with a rubberised material overcoating to provide grip against the garment, and prevent slipping. Similarly, the rubberised coating may provide comfort to the wearer.

The garment closure 900 may be used to prevent gaping of a shirt, to provide for the closure of a gap caused by a missing button in a garment, or to reduce a depth of the V-neck of a top, in a similar manner as described above.

Figure 10:
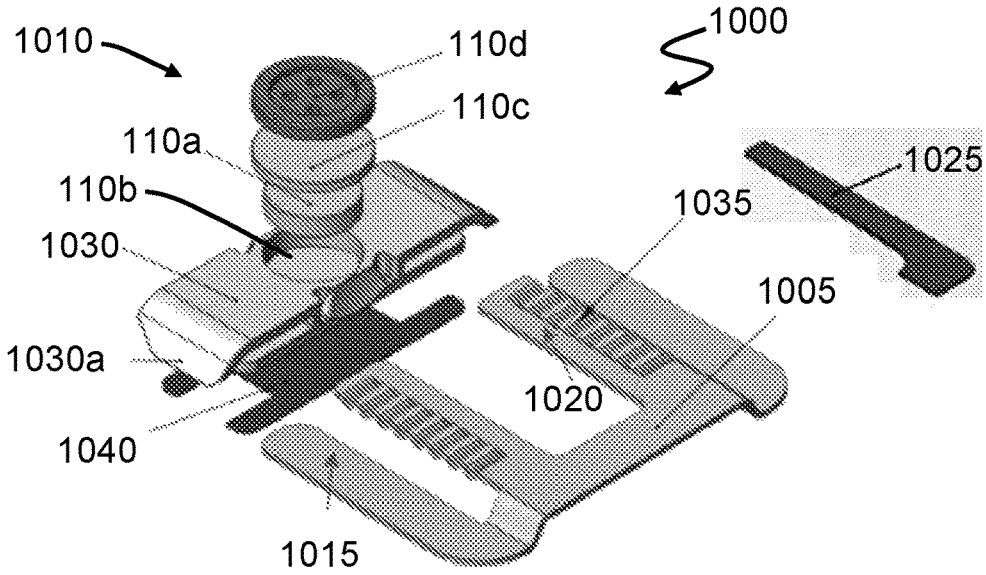
FIG. 10 illustrates an exploded perspective view of a garment closure, according to yet an alternative embodiment of the present invention.

FIG. 10 illustrates an exploded perspective view of a garment closure 1000, according to an alternative embodiment of the present invention. The garment closure 1000 is similar to the closure 100, but where the lower garment panel is clamped by arms and a slider.

In particular, the garment closure 100 includes a lower retainer in the form of a clip 1005, for retaining a lower panel of the garment, and an upper retainer comprising a magnet assembly 1010, coupled to the lower retainer and for retaining an upper panel of the garment.

The clip 1005 comprises a pair of outer arms 1015 that extend outwardly from a base of the clip, and a pair of inner arms 1020 that also extend outwardly from the base. The inner and outer arms extend from the base in substantially the same direction, but the inner arms 1020 lie in a plane above the outer arms 1015.

A slider 1030 engages with the inner arms 1020, and can slide back and forward along the inner arms 1020. The inner arms 1020 include a plurality of alignment notches 1035, to keep the slider 1030 in place when worn.

In a similar manner to the garment closure 100, the lower magnet 110*a* of the magnet assembly 1010 is coupled to the slider using a recess 110*b*, such that an upper surface of the lower magnet 110*a* is flush with an upper surface of the slider 1030.

An upper surface of the outer arms 1015 and a lower surface of the slider 1030 lie substantially in a plane, and are configured to receive the lower panel of the garment there between, such that a clamping force is applied to the lower panel of the garment.

An upper surface of the outer arms 1015 includes a non-slip coating 1025 in the form of a rubber sheet, and the lower surface of the slider 1030 includes a similar non-slip coating 1040, to preventing the clip garment closure 1000 from inadvertently moving relative to the lower panel of the garment.

The slider 1030 includes downwardly curved edges 1030*a*, which provide an aesthetically pleasing, and comfortable garment closure 1000.

Figure 11:
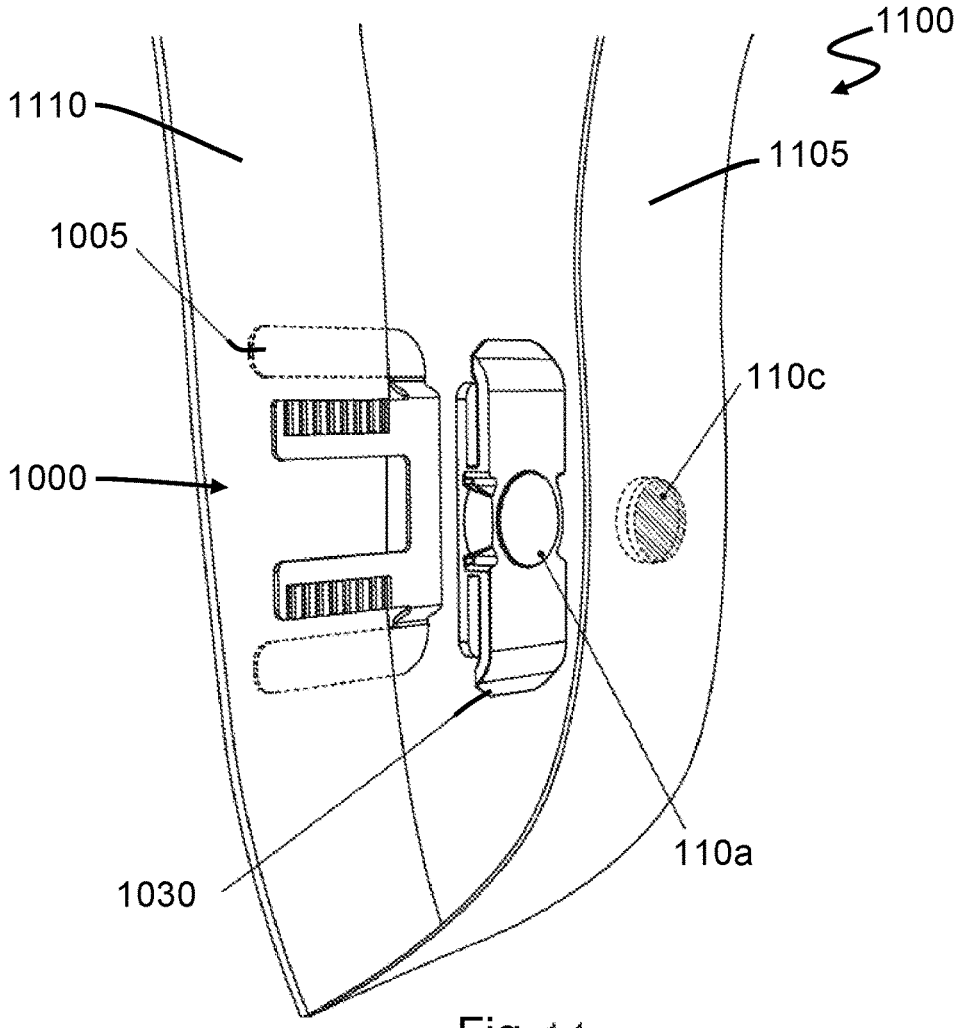
FIG. 11 illustrates an exploded perspective view of the garment closure of FIG. 11 in a button-less configuration with a V-neck top.

FIG. 11 illustrates an exploded perspective view of the garment closure 1000 in a button-less configuration with a V-neck top 1100.

The garment closure 1000 is provided without the button 110*d* (which simply may not be attached). The adhesive, that would typically attach the upper magnet 110*c* to the button 110*d* is instead used to attach the upper magnet 110*c* to an inside of an outer panel 1105 of the V-neck top 1100. The clamp 1005 is used to clamp an inner panel 1110 of the V-neck top 1100, and the magnets 110*c*, 110*a* pull the inner and outer panels 1105, 1110 together.

While FIG. 11 illustrates a V-neck top, the skilled addressee will readily appreciate that the garment closure is positioned wherever the user requires the removal of a gape but does not want a visible external marker, including shirts, trousers, shorts or skirts.

The garment closures described above advantageously prevent or reduce gaping between overlapping panels of a shirts, which typically occur in a bust/chest area for women or in chest or stomach areas for men. They may also be used to replace, in an emergency or otherwise, lost or damaged buttons to hold together overlapping panels on trousers, shirts, shorts, skirts or the like. As outlined above, the garment closures may reduce the depth of a V in overlapping panels of a V-necked garment. The garment closures are simple to manufacture and use, are reusable, and do not damage the garments on which they are used.

The closures described above may be provided with an adhesive enabling the user to attach a button of his or her choosing. This enables the user to attach a spare button that has been provided with a garment, which further assists in giving the impression that the additional button is a component of the original shirt design.

According to certain embodiments, a kit may be provided including a garment closure and several upper magnets. The upper magnets may have adhesive pre-applied, to enable the closure to be used with different buttons on different garments.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A garment closure for closing a gape formed between first and second panels of a garment, the garment closure comprising:

a first retainer including a biasing member configured to engage with and thereby retain the first panel of the garment; and a second retainer, coupled to said first retainer, configured to engage with and thereby retain the second panel of the garment, to thereby close a gape between the first panel and the second panel, wherein said first retainer is configured to retain the first panel independently of said second retainer retaining the second panel and when retained, at least one of said first retainer and second retainer is concealed by one of the first and second panels of a garment.

2. The garment closure according to claim 1, wherein the first and second panels are overlapping, and said first and second retainers are overlapping.

3. The garment closure according to claim 1, wherein said first retainer comprises a retaining member.

4. The garment closure according to claim 1, wherein said biasing member comprises a clamping member.

5. The garment closure according to claim 4, wherein said clamping member comprises first and second resilient members extending in approximately the same direction.

6. The garment closure according to claim 5, wherein said first resilient member is located above said second resilient member.

7. The garment closure according to claim 5, wherein said first resilient member is located adjacent to said second resilient member.

8. The garment closure according to claim 4, wherein said clamping member comprises gripping surfaces for gripping the first panel of the garment.

9. The garment closure according to claim 1, wherein said second retainer comprises a magnet assembly.

10. The garment closure according to claim 9, wherein said magnet assembly comprises an outer assembly of the garment closure, adjacent an outside of the garment; and said first retainer comprises an inner assembly of the garment closure, adjacent an inside of the garment.

11. The garment closure according to claim 10, wherein said magnet assembly comprises an inner magnet, coupled to said first retainer and on an inside of the second panel, and an outer magnet, configured to be outside of the second panel.

12. The garment closure according to claim 11, further comprising a button adhered to said outer magnet.

13. The garment closure according to claim 9, wherein said magnet assembly comprises a first magnet, coupled to said first retainer, and a second magnet comprising said second retainer, and wherein said second magnet is configured to be adhered to an inside of the second panel.

14. The garment closure according to claim 13, wherein said second magnet is configured to be releasably adhered to the inside of the second panel.

15. The garment closure according to claim 14, wherein said second retainer includes an adhesive coating for retaining the second panel of the garment.

16. The garment closure according to claim 12, further comprising a slider configured to enable said magnet assembly to slide relative to said first retainer.

17. The garment closure according to claim 16, wherein said slider is formed with notches to keep said slider from moving while being worn.

18. The garment closure according to claim 1, wherein said second retainer comprises a retaining member.

19. The garment closure according to claim 18, wherein said retaining member comprises a clamping member.

20. The garment closure according to claim 19, wherein said clamping member is at least partly transparent.

* * * * *